United States Patent [19]

Hucknall

[11] Patent Number: 4,754,522

[45] Date of Patent: Jul. 5, 1988

[54] DOOR HOLDERS FOR SELECTIVELY POSITIONING DOORS AGAINST CLOSURE

[76] Inventor: Richard Hucknall, 3 Fairview Ave., Great Neck, N.Y. 11023

[21] Appl. No.: 810,222

[22] Filed: Dec. 18, 1985

[51] Int. Cl.[4] ..... E05F 3/04

[52] U.S. Cl. ..... 16/51; 16/71; 16/323; 16/333; 16/DIG. 17

[58] Field of Search ..... 16/49, 51, 58, 66, 71, 16/72, 323, 333, DIG. 9, DIG. 10, DIG. 17

[56] References Cited

U.S. PATENT DOCUMENTS

| | | | |
|---|---|---|---|
| 1,515,155 | 11/1924 | Meagher | 16/71 |
| 2,277,316 | 3/1942 | Garrison | 16/DIG. 17 X |
| 2,940,111 | 6/1960 | Patriquin | 16/66 |
| 3,543,327 | 12/1970 | Nilsson | 16/49 |

*Primary Examiner*—Fred Silverberg

*Attorney, Agent, or Firm*—Robert R. Strack

[57] ABSTRACT

A door holding mechanism having interacting members with cooperating cam surfaces that selectively, by touch, effect locking or sliding movement to permit unrestricted door movement or rigid positioning in partial open conditions.

14 Claims, 4 Drawing Sheets

DOOR HOLDERS FOR SELECTIVELY POSITIONING DOORS AGAINST CLOSURE

This invention relates to door holders, and more particularly, to door holders operative to selectively position the door responsive to movement of the door itself.

BRIEF DESCRIPTION OF THE INVENTION

1. Description of the Prior Art

The function of securing doors, lids, hatches, and other closure devices, in an open or partially open position, has been carried out in a variety of ways. Hooks are used to fasten open doors to adjacent walls. Chains are frequently used to permit doors to rest in positions determined by the length of the chain. Wedges and blocks are used to restrict door movement. When hydraulic closers are part of the system, means may be provided for restraining movement of the piston arm.

Most door holding devices require an operator to manually set them into the desired position. This, in turn, presupposes that the operator has his hands free to manipulate the devices. Many devices must be seen to permit the operator's manual adjustment, and cannot be easily set in conditions where the light is dim, or nonexistant. A large majority of door holding devices require some degree of manual dexterity and some cannot be manipulated by persons with physical handicaps.

2. The Present Invention

The present invention is a door holder suitable for attachment to almost all hinged or pivoted closure members, which are biased to a closed condition, by springs, gravity, or other means. The invention permits unrestricted opening and closing of such a closure member unless and until the operator chooses to set the member in a particular open position. "Setting" or positioning the member in the particular open condition is accomplished by stopping the opening action and releasing the door to return slightly under influence of the door closure biasing means, without touching the door holding unit. Thus, the operator may merely touch the member with his shoulder or hip and position the member open, or release it from a previously set position.

An object of the invention is to provide an improved door holder.

Another object of the invention is to provide an improved door holder that permits the door to usually open and close without restriction and which does not require manual dexterity to set it.

Another object of the invention is to provide an improved door holder that is set by touching only the door itself, and not the holder.

Another object of the invention is to provide an improved door holder that can be attached to existing doors and which operates in conjunction with all door closure mechanisms.

In accordance with a particular embodiment of the invention, these objects are achieved with a door holder having an outer housing connected to a door or other closure member, and catch housing connected to the adjacent frame or jamb. A catch device within the catch housing is a cam follower designed to cooperate with a cam surface on the outer housing. The catch device is adapted to be "set" in several positions that render it either operative to hold the door in a particular position, or to permit unrestricted movement. Setting includes merely stopping the door at the general position to be maintained, when the catch device generates an audible signal.

The above, and other objects of this invention will be more clearly understood and appreciated from the following detailed description, taken in conjunction with the drawings.

DETAILED DESCRIPTION OF THE INVENTION

Figure 1:
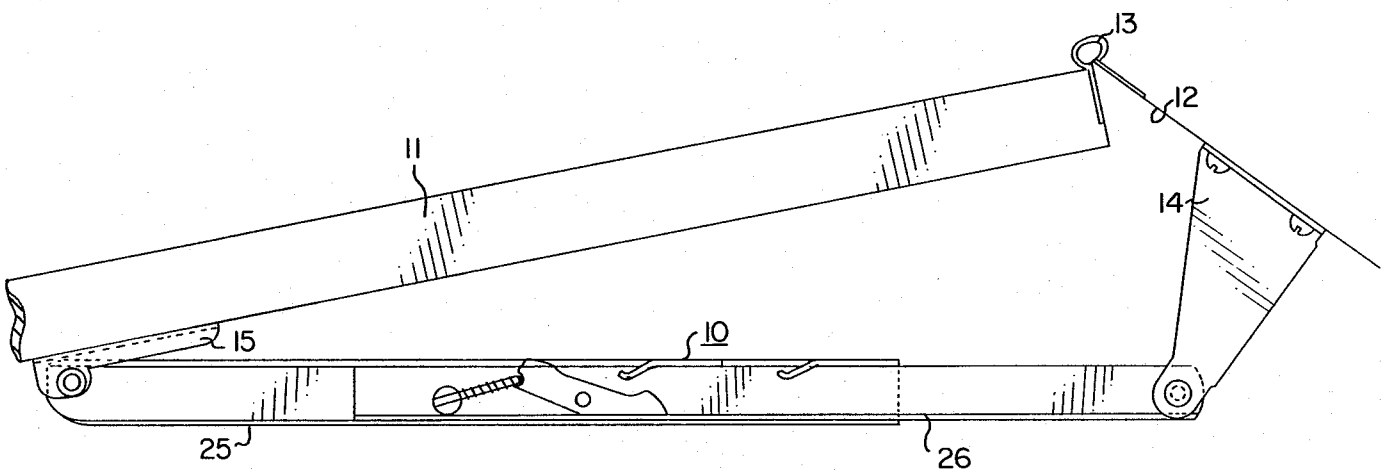
FIG. 1 is a schematic illustration of an embodiment of the invention connected between a door and jamb.

Referring to FIG. 1, it will be seen that door holder 10 is adapted to be mounted between a door 11 and jamb 12. The door is adapted to rotate about jamb 12 by hinge member 13. Although not shown, it is to be understood that the door is biased to a normally closed condition by either a spring, hydraulic closer, gravity, or some equivalent means. Door holder 10 is pivotally connected to door 11, by a door mounting element 15. It is also pivotally mounted to the jamb by jamb mounting element 14. As will be evident from the following description, the door holder has cooperating elements consisting of an outer housing 25 and catch housing 26 which are adapted to telescopically cooperate permitting respective camming surfaces to carry out the features of the present invention. The outer housing 25 may be formed by bending a flat material into an elongated chamber suitable to slidingly receive said catch housing 26. In this case, one surface area of outer housing 25 may be formed as the camming surface to define particular locations that will effect selective actuation of the catch means described hereinafter.

Figure 2:
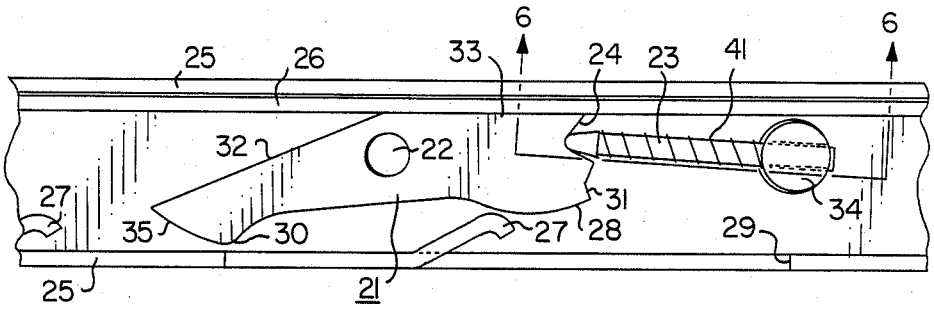
FIG. 2 is an enlarged view showing the internal mechanism of an embodiment of the invention as the catch is cocked ready to either permit further opening of a connected door, or to permit the door to close without impediment.
Figure 3:
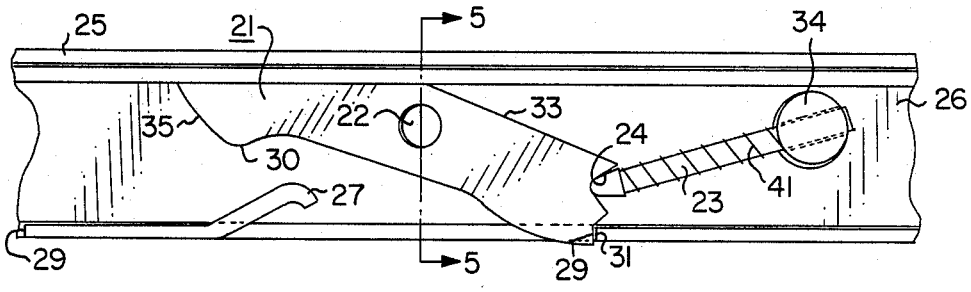
FIG. 3 is an enlarged view of an embodiment of the invention wherein the catch is engaged at a track stop surface, holding the door open in a selected position.
Figure 5:
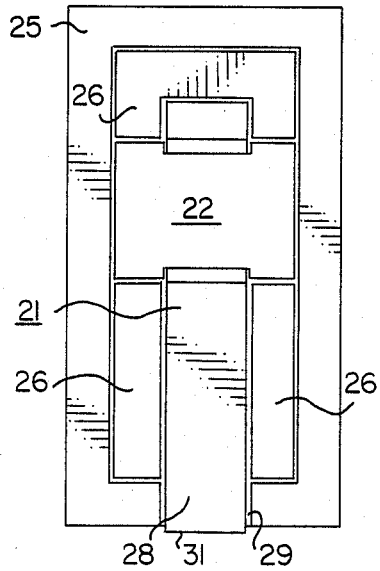
FIG. 5 is a cross-sectional view taken along the lines 5—5 of FIG. 3.
Figure 7:
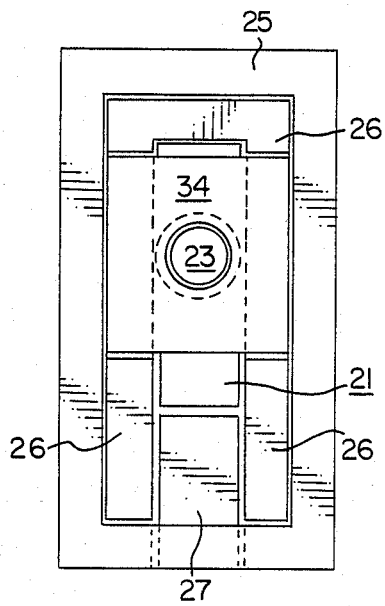
FIG. 7 is a cross-sectional view of the spring pin and swivel assembly taken along lines 7—7 in FIG. 6.
Figure 4:
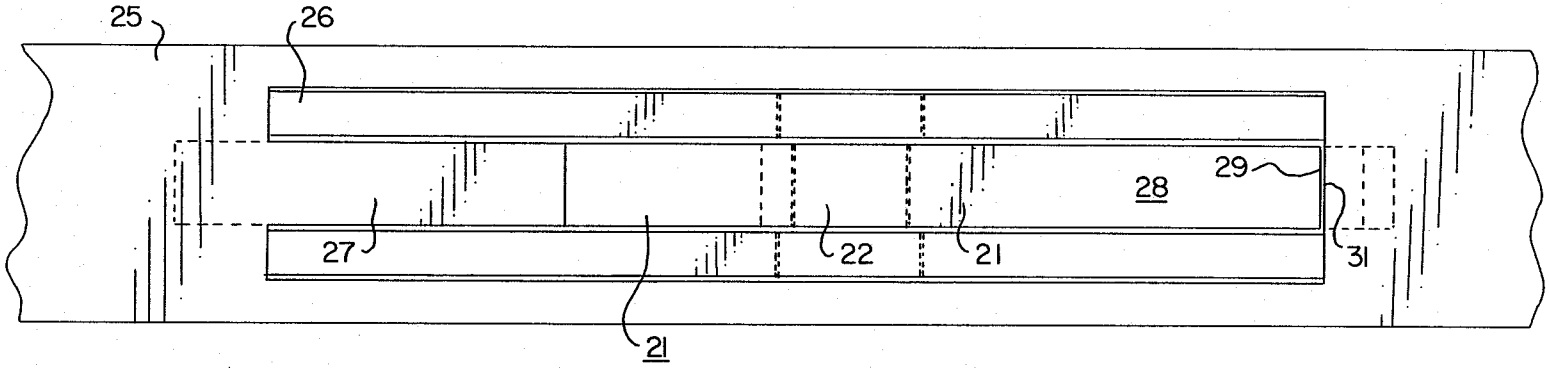
FIG. 4 is a side view of the preferred embodiment of the invention, showing the portion of the device in FIGS. 2 and 3, with the catch element over a stop opening.
Figure 6:
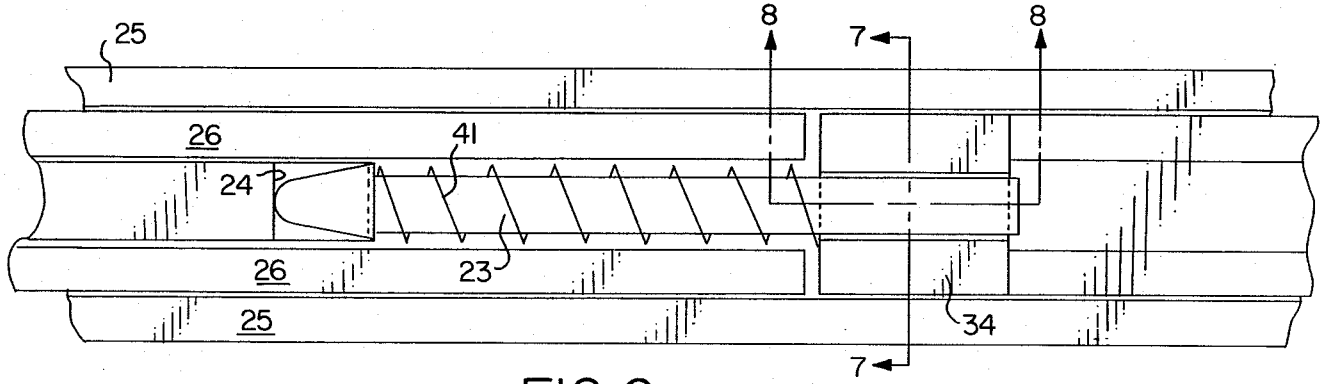
FIG. 6 is a cross-sectional view of the spring pin assembly taken along lines 6—6 in FIG. 2.

FIGS. 2 and 3 illustrate separate positions of the outer housing and catch housing when the door is in different positions. These FIGURES should be considered together in order to appreciate a typical operating sequence.

When door 11 is closed, catch 21 resides in a quiescent condition cocked with its leading surface 33 resting against the inner surface of catch housing 26. It is held in this position by pressure at the spring pin notch 24, exerted by spring pin 23. This pressure is achieved due to the compression of spring 41.

As the door is opened, the catch sliding cam surface 28 moves against the inside surface of outer housing 25. When the door reaches a predetermined hold position (either 30°, 45°, or some other position selected by the location of a notch in the outer housing 25) catch 21 drops into the slot coming to a stop with an audible click as the catch back surface 32 of catch 21 comes into contact with the inside surface of catch housing 26. If the door is released at this time, catch lock surface 31 will come into contact with track stop surface 29 and hold the door fixed. If this position is 30 or 45 degrees, it will allow medium-sized packages to be passed through the door. Where the door is a hatch cover, it may be a position established to provide ventilation.

By continuing to move the door further in an open direction, the catch 21 automatically releases as cam follower surface 28 moves over the cam surface 27. Thereafter, if the door is released while the follower is in this condition, it will proceed unimpaired back to a closed condition.

If it is not desired to hold the door open, catch 21 will continue sliding back on surface 32 until the cam surface 28 contacts track cam 27 causing the spring pin 23 to move up with the catch until the spring pin notch 24 is above the center of both the catch locking pin 22 and the spring swivel 34. Under these conditions, the catch leading surface 33 will engage the inner surface of catch housing 26 and the door will be free to close. When the catch lock surface 31 is in an up position, it passes over track stop surface 29 as the door closes, until the trigger cam surface 30 contacts track cam 27 flipping the catch back down on sliding surface 28 and back to its original starting position where it is cocked and ready to either hold the door open or make another passive "round-trip".

In order to hold a door all the way open, a second track stop surface 29 is provided in the outer housing 25. After the first track cam 27 is passed, and the catch 21 is cocked upwardly, it will slide with its leading surface 33 upward and its trigger cam surface 30 downward. When catch 21 approaches the second track slot, trailing cam surface 25 will contact track cam 27 flipping the catch 21 down so it can drop into the second slot and make contact between the catch lock surface 31 and track stop surface 29. In order to release the door from this second open position, it is simply pushed slightly further forward pulling catch 21 over track cam 27 to again cock it into an upward position. Now, the door can be released and it will travel the entire trip back to a closed condition.

To more fully understand the important features of the invention and the interrelated structures that cooperate to achieve the objectives of the invention, consideration will be given to a number of the critical elements. These elements are shown enlarged in FIGS. 5 through 8.

The catch 21 is the locking member between the inner catch housing 26 and the outer housing 25. It is attached by a catch locking pin 22 to the catch housing. All movements of the catch 21 are fully automatic. They are controlled by simply the opening and closing of the door. In this embodiment there is a choice of two holding positions. The first secures the door halfway open and the second secures the door in a fully opened position. Each "hold" position is located by an audible click. By releasing the door at this point it is automatically set into the "hold" position. In order to release the door, it is moved a few degrees, or few inches, beyond the "hold" point providing the clicking sound again, and cancelling the "hold" action from taking place.

Catch holding pin 22 is provided to hold the assembled elements of the catch and housing together. This can be seen more clearly in the cross-sectional view of FIG. 5. When the catch 21, catch locking pin 22, spring pin 23, spring pin swivel 24, and spring 41 are assembled in proper sequence, the assembly remains interconnected without the possibility of dis-assembly until physically taken apart. In order of assembly, the catch 21 is positioned within housing 26; catch locking pin 22 is inserted within the catch; spring 41 is then mounted upon pin 23 and the pin is positioned within the aperture in swivel 34. Pin 23 is then engaged within notch 24. The swivel 34 is held in place by the width of spring pin 23 and spring 41, which in turn are locked between swivel 34 and the notch 24.

Catch spring pin 23 transfers the pressure of spring 41 to catch 21 in order to keep it at all times either in an up (open) or down (cocked) position against outer housing 25. The front portion of spring pin 23 fits into the spring pin notch 24 in catch 21 and provides an area for the spring 41 to push against.

The swivel 34 allows spring pin 23 to move up and down with catch 21. It rotates with spring pin 23 and the associated spring 41, providing a backstop for the spring and allowing pin 23 to move backward and forward as well as up and down. As noted previously, an important function of swivel 34 is to provide means for easy assembly of the catch and cocking components.

The inner catch housing 26 slides with a telescoping action inside outer housing 25. It is the mounting vehicle for the catch and spring pin assembly. It attaches to the door jamb and by its action with catch 21, engages to lock with the outer housing 25 when the door is in one of the "hold" positions.

There may be several embodiments of outer housing 25. These depend upon the particular type of closure device employed on the door. For example, a spring may be mounted between the door mounting element and jamb mounting element. Alternatively, the type of hydraulic closer disclosed herein may be provided between these elements.

Figure 11:
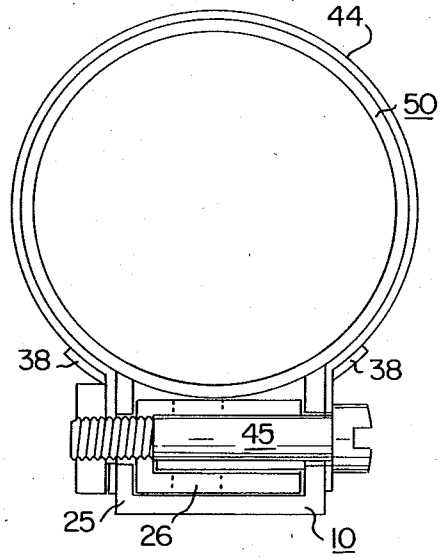
FIG. 11 is a cross-sectional view taken along lines 11—11 in FIG. 9.
Figure 10:
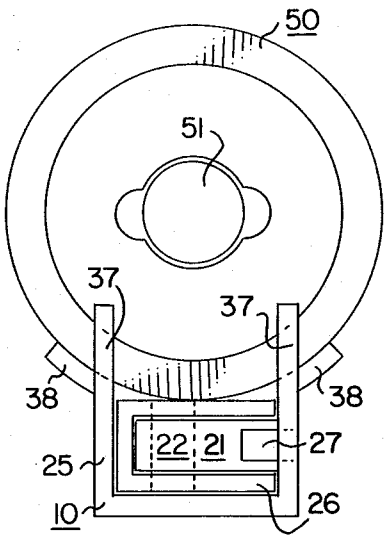
FIG. 10 is a cross-sectional view taken along lines 10—10 in FIG. 9.
Figure 8:
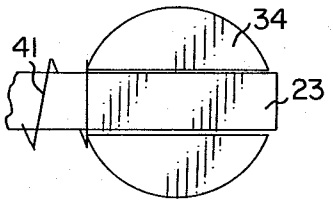
FIG. 8 is a cross-sectional view of the spring pin and swivel assembly taken along lines 8—8 in FIG. 6.
Figure 9:
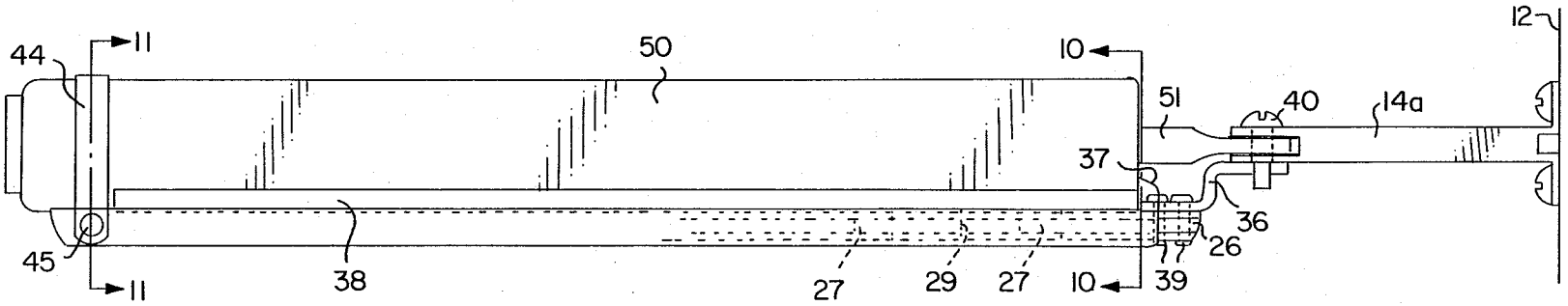
FIG. 9 is a side view of an embodiment of the invention, showing the control mechanism in combination with a hydraulic closure device.

FIGS. 9–11 illustrate the mounting of the mechanism of this invention in conjunction with a typical hydraulic closure cylinder 50. It will be understood that such cylinders are designed to return any opened door or cover to a desired closed position.

Cylinder 50 is pivotally connected via arm 51, and pin 40, to jamb mounting bracket **14*a*. As the door element is opened, arm 51 extends within cylinder 50. The outer housing 25 of the holding mechanism of the invention is affixed to the bottom of the cylinder 50, as shown in FIG. 9. Shoulder 37 rests against the rear of cylinder 50, and absorbs the force exerted against the unit when the door is held open, thereby relieving any strain on the connection between the housing 25 and closure cylinder 50. Bracket 36 rigidly connects the catch housing 26 to a threaded portion of pin 40 and thus to the jamb mounting bracket 14*a***.

The outer housing 25 is preferably attached to cylinder 50 along its longitudinal dimension, by mounting flanges or strips 38. These flanges may be flexible or rigid elements provided with an adhesive coating to assure simple and aligned connection between the parts. For additional mounting security, a band 44 may be used at the remote end of cylinder 50.

Particular embodiments of the invention have been shown and described. Modifications of these embodiments will be apparent to those skilled in the art. All such modifications coming within the scope of the following claims, are intended to be covered thereby.

What is claimed is:

1. A door holder for selectively positioning a door against closure, comprising means for biasing said door to a closed condition, a first housing having stop surfaces at particular locations to establish particular door positions, a second housing having a cam follower pivotally connected to engage said stop surfaces, said first and second housings being pivotally connected between said door and a fixed surface, said stop surfaces and said cam follower having cooperating camming surfaces that are maintained disengaged at all times except when said door is released during opening while said cam follower is at one of the locations of the stop surfaces, actuating means for maintaining said cam follower in either of two stable conditions, the first of said conditions yielding unrestricted passage past said locations, and the second of said conditions yielding contact with said stop surfaces, whereby said door cannot close, said first and second housing being telescopingly engaged, said first housing being pivotally connected to said door, and said second housing being pivotally conntected to said fixed surface.

2. A door holder as defined in claim 1, wherein said particular door positions are approximately 45° and 90° opened.

3. A door holder as defined in claim 1, wherein said first housing is formed by bending a flat material into an elongated chamber suitable to slidingly receive said second housing, one surface area of said first housing being formed as a camming surface to define said particular locations and effect selective actuation of said catch means.

4. A door holder as defined in claim 1, including means operative to produce an audible sound when said cam follower moves into proximity with said particular locations.

5. A door holder as defined in claim 1, wherein said means for producing an audible sound is an integral part of said cam follower.

6. A door holder as defined in claim 5, wherein said means for producing an audible sound is a surface of said cam follower and said actuating means, said actuating means forcing said cam follower surface against said second housing with sufficient force to develop said audible click.

7. A door holder as defined in claim 1, wherein each said particular location is defined by a gap in a continuous cam surface.

8. A door holder as defined in claim 7, wherein said stop surface is at the leading edge of said gap.

9. A door holder as defined in claim 8, including a reset surface at the trailing edge of said gap to reset said cam follower to said first condition when the trailing end thereof passes over said reset surface during door opening.

10. A door holder as defined in claim 9, wherein the distance between the leading and trailing edges of said gap is less than the distance between the leading and trailing ends of said cam follower.

11. A door holder as defined in claim 10, wherein said reset surface is interposed into the path of said cam follower during opening and closing of said door.

12. A door holder as defined in claim 11, wherein each said particular location is developed as a cutout in a flat surface, said stop surface being the leading edge of said cutout and said reset surface being a raised offset at the trailing edge of said gap.

13. A door holder as defined in claim 1, wherein said actuating means includes a pin biased into contact with said cam follower, said pin being pivotally mounted to said second housing to apply a relatively constant force against said cam follower in both of said stable conditions.

14. A door holder as defined in claim 1, wherein said means for biasing said door to a closed condition includes a hydraulic door closer, said first housing being rigidly connected to said hydraulic door closer and said second housing being pivotally connected to said fixed surface.

* * * * *